US006526901B2

(12) United States Patent
Iacoboni

(10) Patent No.: US 6,526,901 B2
(45) Date of Patent: Mar. 4, 2003

(54) RETRACTABLE MAST FOR SAILBOATS

(76) Inventor: Camillo M. Iacoboni, 806 Bayside Dr., Stevensville, MD (US) 21666

( * ) Notice: Subject to any disclaimer, the term of this patent is extended or adjusted under 35 U.S.C. 154(b) by 0 days.

(21) Appl. No.: 10/078,364

(22) Filed: Feb. 21, 2002

(65) Prior Publication Data

US 2002/0139284 A1 Oct. 3, 2002

Related U.S. Application Data

(60) Provisional application No. 60/279,668, filed on Mar. 30, 2001.

(51) Int. Cl.[7] ..... B63H 9/06
(52) U.S. Cl. ..... 114/90
(58) Field of Search ..... 114/90

(56) References Cited

U.S. PATENT DOCUMENTS 2,595,307 A 5/1952 Selberg
3,658,189 A 4/1972 Brown et al.
4,016,823 A 4/1977 Davis
4,525,999 A 7/1985 Inman
4,718,370 A 1/1988 Portell-Vila
5,263,429 A * 11/1993 Brinkmann ..... 114/105
6,000,354 A 12/1999 Vanlergerghe

* cited by examiner

*Primary Examiner*—Jesus D. Sotelo
(74) *Attorney, Agent, or Firm*—Richard C. Litman

(57) ABSTRACT

A retractable mast for sailboats. The mast, which retracts telescopically, comprises an inner core containing air sealed air chambers, either separated or coextensive, which are pressurized when the mast is fully extended. A compressed air bottle or air compressor driven by the boat engine supplies pressurized air to raise the mast. Valves control the pressure release for extension or retraction. The mast may also be operated hydraulically or by stored or generated pressurized gas. The air chambers may contain inflatable bags to retain the pressurized air in each chamber. A stiffener may be erected adjacent the fully extended mast to maintain it in the fully extended position. The stiffener also holds rings which travel along its length for holding the main sail when hoisted. A bracket mounts to the mast and extends around the stiffener, providing for rotatably mounting the boom aft of the stiffener.

20 Claims, 9 Drawing Sheets

RETRACTABLE MAST FOR SAILBOATS

CROSS-REFERENCE TO RELATED APPLICATION

This application claims the benefit of U.S. Provisional Patent Application Ser. No. 60/279,668, filed Mar. 30, 2001.

BACKGROUND OF THE INVENTION

1. Field of the Invention

The present invention relates to sailboat standing rigging, and, more particularly, to retractable masts for sailboats.

2. Description of Related Art

Retractable masts for sail boats are desirable, particularly when the mast must be otherwise stepped f or passing under a low bridge, for transport on a trailer, or for storage. Previous retractable masts have complicated mechanical components which are subject to corrosion or breakage, or require hydraulic or fluid seals between nested portions or lengths which require close tolerances and have seals which are subject to wear and eventual leakage.

U.S. Pat. No. 6,000,354, issued Dec. 14, 2000, to Vanlerberghe describes a retractable mast employing mechanical parts and lines and may be deployed only in a fully extended or fully retracted position. The device of the '354 patent is subject to wear and corrosion and line breakage.

U.S. Pat. No. 4,718,370, issued Jan. 12, 1988, to Portell-Vila describes a mechanically extendable and retractable mast. The device of the '370 patent is subject to wear and corrosion in a marine environment and the crank mechanism would be an encumbrance on a boat having a head sail.

U.S. Pat. No. 4,525,999, issued Jul. 2, 1985, to Inman describes a pneumatically operated boom or actuator, extended by the pressure of gasses generated internally by a gas generator. The device of the '999 patent is for a single permanent deployment and thus is not appropriate for a retractable sailboat mast.

U.S. Pat. No. 4,016,823, issued Apr. 12, 1977 to Davis describes a retractable mast having nested portions locked in an extended state by detents and manually operated. The device of the '823 patent would be practical only for relatively small masts and is limited to discreet lengths of extension.

U.S. Pat. No. 3,658,189, issued Apr. 25, 1972, to Brown et al. describes a hydraulically operated extendable and retractable boom for use in a vehicle mounted lift using independent hydraulic actuators for each boom section. The device of the '189 patent is complicated and expensive and would be too heavy for use as a mast on a sailboat, as well as subject to corrosion in a marine environment.

U.S. Pat. No. 2,595,307, issued May 6, 1952, to Selberg describes a hydraulically operated retractable boom or ram for use on a vehicle. The device of the '307 patent requires close tolerances and seals which are subject to corrosion and subsequent leakage in a marine environment.

None of the above inventions and patents, taken either singly or in combination, is seen to describe the instant invention as claimed.

SUMMARY OF THE INVENTION

The present invention is a retractable mast for sailboats. The mast, which retracts telescopically, comprises an inner core containing sealed air chambers which are pressurized when the mast is fully extended. The chamber may contain bags for holding the pressurized air. An air compressor, which may be powered by the boat engine, is utilized to supply pressurized air. A pressurized air bottle may, also, provide pressurized air. Valves control the pressure release for extension or retraction. The mast may also be operated hydraulically or by stored or generated pressurized gas.

Accordingly, it is a principal object of the invention to provide a retractable and extendable mast for use on sailboats.

It is another object of the invention to provide a mast as above having multiple sections which nest together in the fully retracted state and telescope upward upon extension.

It is a further object of the invention to provide a mast as above which contains one or more sealed air chambers within the interior of the mast, which is attached to a source of pressurized fluid which, upon entrance to the sealed air chamber, inflates the chamber, thus extending upper portions of the mast upward.

It is yet another object of the invention to provide a mast as above which contains one or more bags within the interior of the mast, which are attached to a source of pressurized fluid which, upon entrance to the bag, inflates the bag, thus extending upper portions of the mast upward.

Still another object of the invention is to provide a mast which has seals between nested movable mast sections so as to provide an open mast interior which is raised or lowered through control of pneumatic or hydraulic pressure.

Yet another object of the invention to provide a mast as above wherein each movable mast section has a lower end plate having orifices therethrough so as to control the rate of deployment of the nested mast section.

Still another object of the invention is to provide a mast as above which has valves to release the pressurized fluid, allowing the bags to deflate and the upper portions of the mast to retract into the lower portion.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings. Figures are not necessarily drawn to scale, but are for illustrative purposes only.

DETAILED DESCRIPTION OF THE PREFERRED EMBODIMENTS

The present invention is a retractable mast for sail boats which is useful when the mast must be otherwise stepped for passing under a low bridge, for transport on a trailer, or for storage. Previous retractable masts have complicated mechanical components which are subject to corrosion or breakage, or require hydraulic or fluid seals between nested portions or lengths which require close tolerances and have seals which are subject to wear and eventual leakage.

The present invention employs inflatable bags mounted internally to the mast which, when supplied with pressurized air, lift movable sections of the nested mast resulting in erection of the mast, and, upon deflation by air control valves, the mast is retracted. The mast may also be operated by direct air pressure to a telescoping mast which is sealed airtight between sections. This embodiment would be most useful where the boat is in a fresh water environment where corrosion is less severe than a marine environment.

Figure 1:
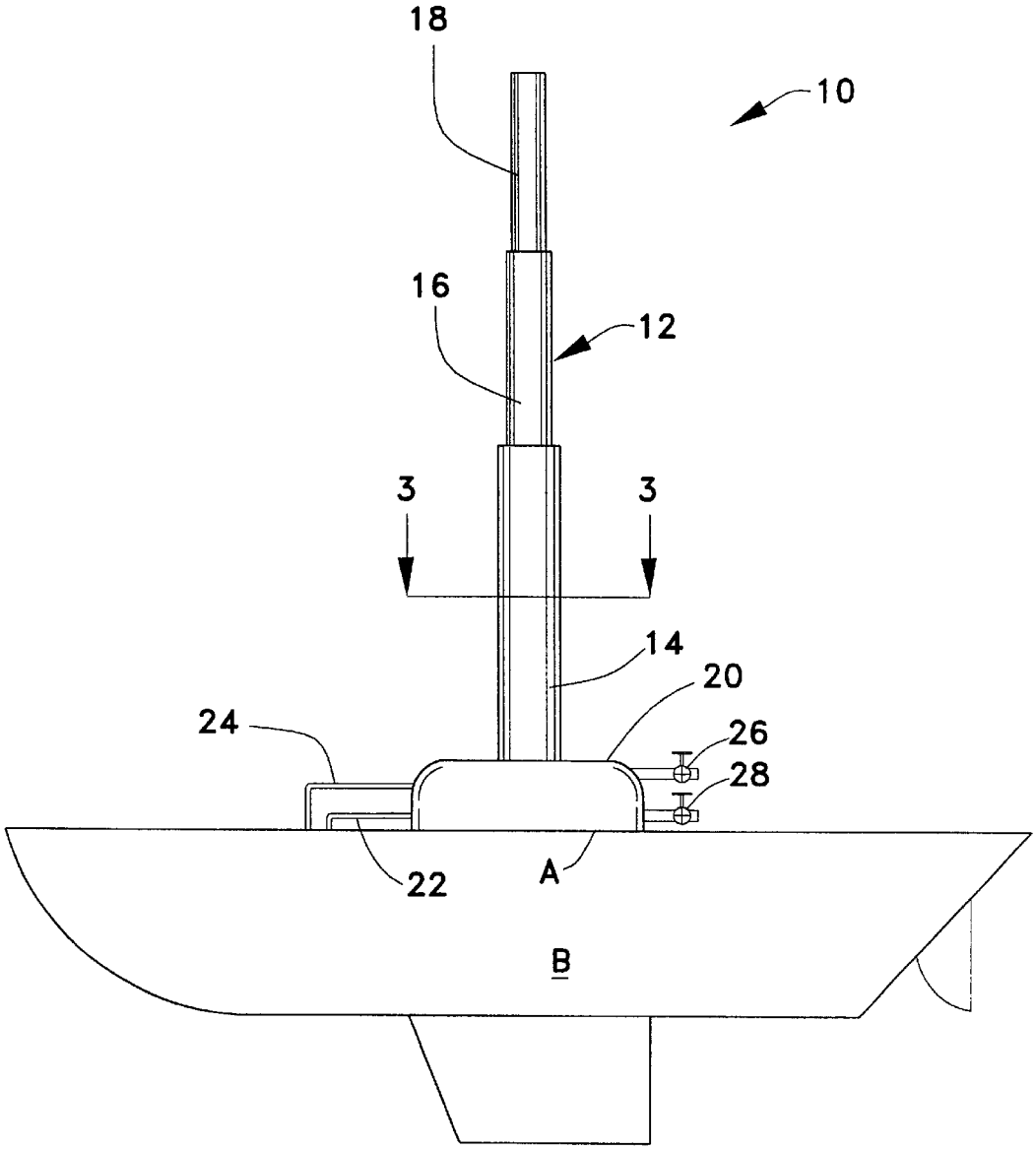
FIG. 1 is a diagrammatical, environmental, elevational view of a retractable mast for sailboats according to the present invention

Referring to FIG. 1, retractable mast sailboat system 10 features retractable mast 12 having lower section 14, center section 16, and upper section 18. Mast boot 20 surrounds the lower portion of lower section 14 and shields fittings for lower section pneumatic line 22 and center section pneumatic line 24. Pneumatic lines 22 and 24 travel through deck A of sailboat B. Lower section relief valve 26 and center section relief valve 28 are mounted on boot 20 for relieving pressure in mast lower section 14 and mast center section 16, respectively.

Figure 2:
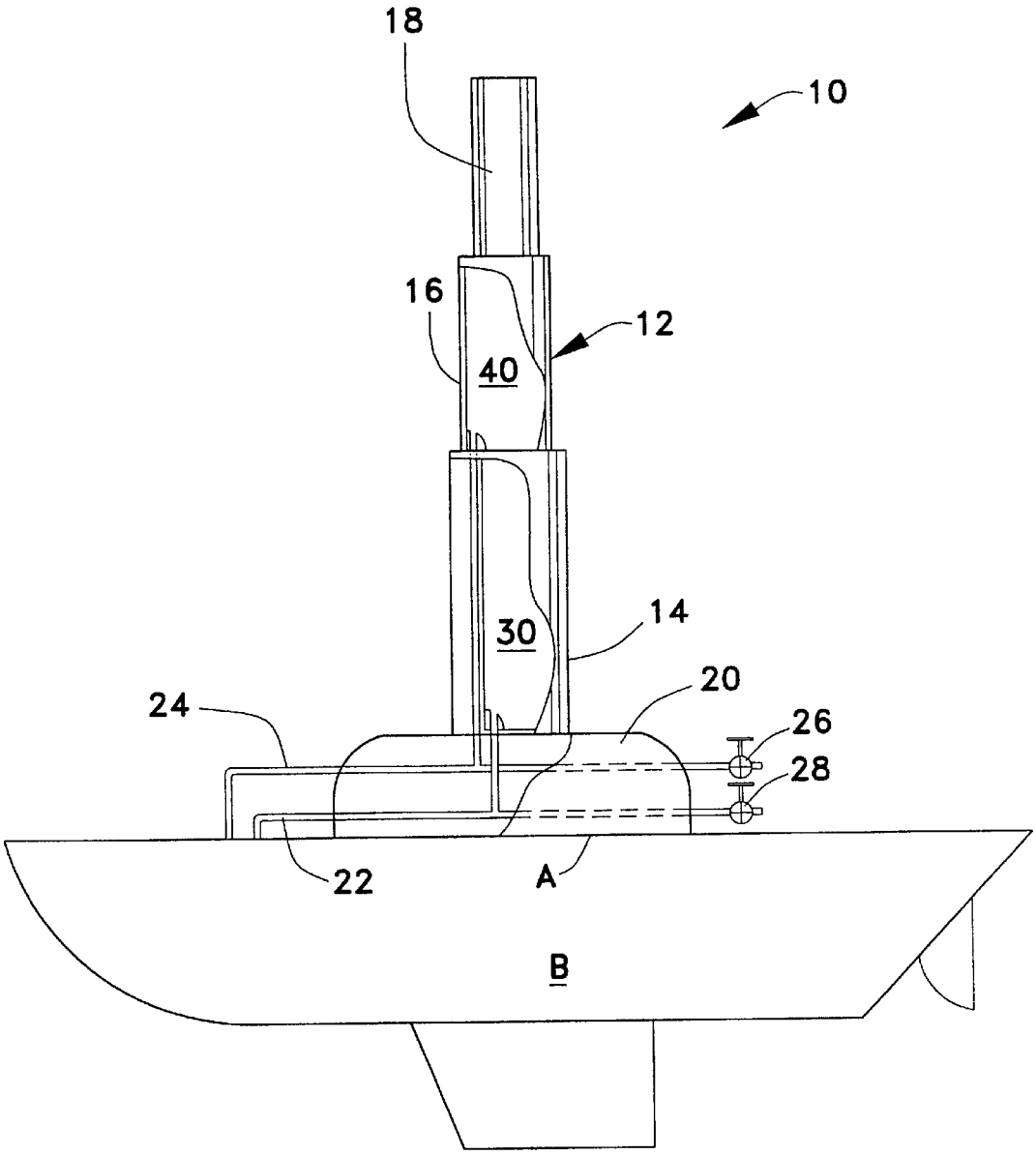
FIG. 2 is a diagrammatical, environmental elevational view similar to FIG. 1 with portions of the mast portions and boot broken away.

Referring to FIG. 2, lower mast section 14 and central mast section 16 are shown partially broken away, exposing lower lift bag 30 and upper lift bag 40, respectively. Mast boot 20 houses portions of lower section pneumatic line 22 and center section pneumatic line 24 which each branch to respective lower section relief valve 26 and center section relief valve 28.

Figure 3:
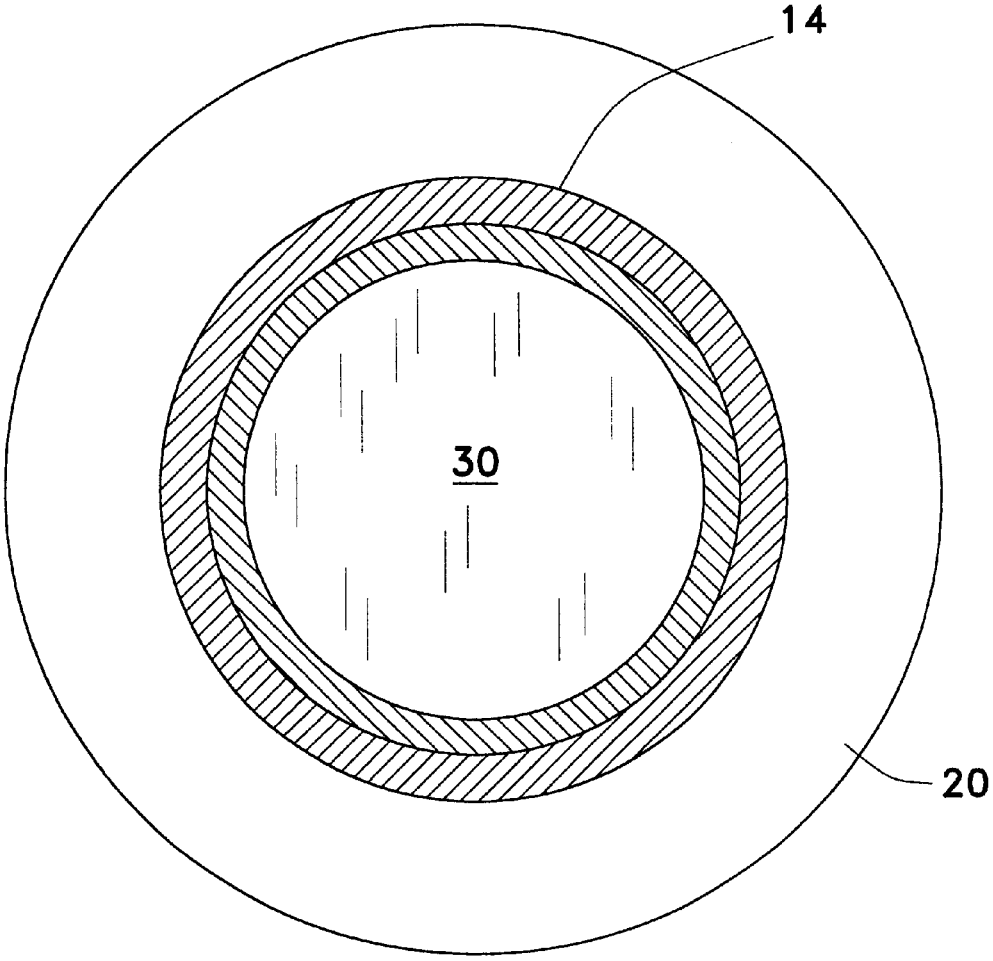
FIG. 3 is a section view drawn along lines 3—3 of FIG. 1.

Referring to FIG. 3, there is shown a sectional view of lower mast section 14 having lower lift bag 30 internal to lower mast section 14 and lower mast boot 20 surrounding lower mast section 14. Pneumatic lines and valves, and deck A are not shown.

Figure 4:
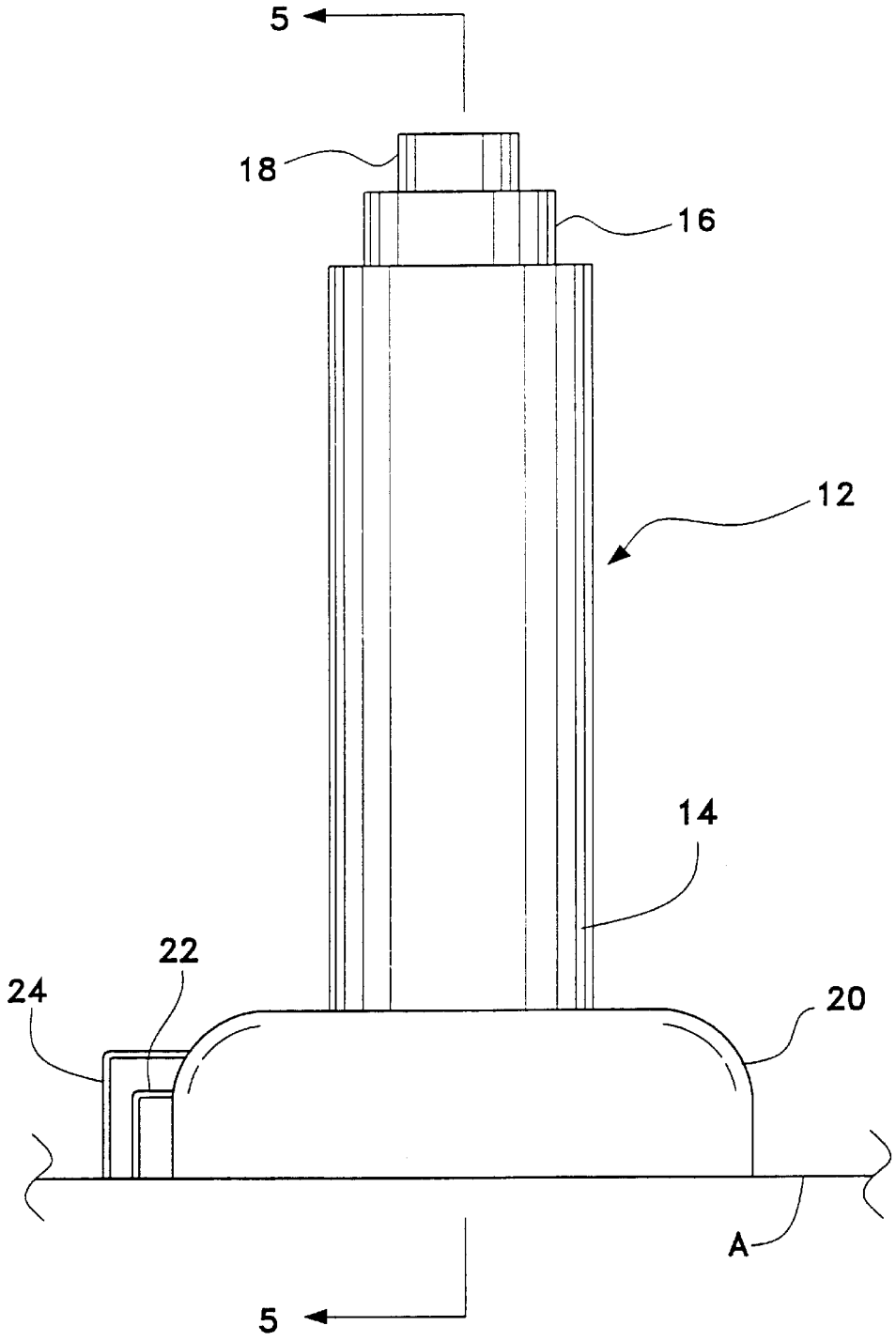
FIG. 4 is a diagrammatical, elevational view of the retractable mast of FIG. 1 in the retracted position.

Referring to FIG. 4, there is depicted the retractable mast 12 in its fully retracted position wherein lower mast section 14 houses center mast section 16 and upper mast section 18(not shown) and is surrounded at its lower end by boot 20 at deck A. Pneumatic lines and valves are not shown.

Figure 5:
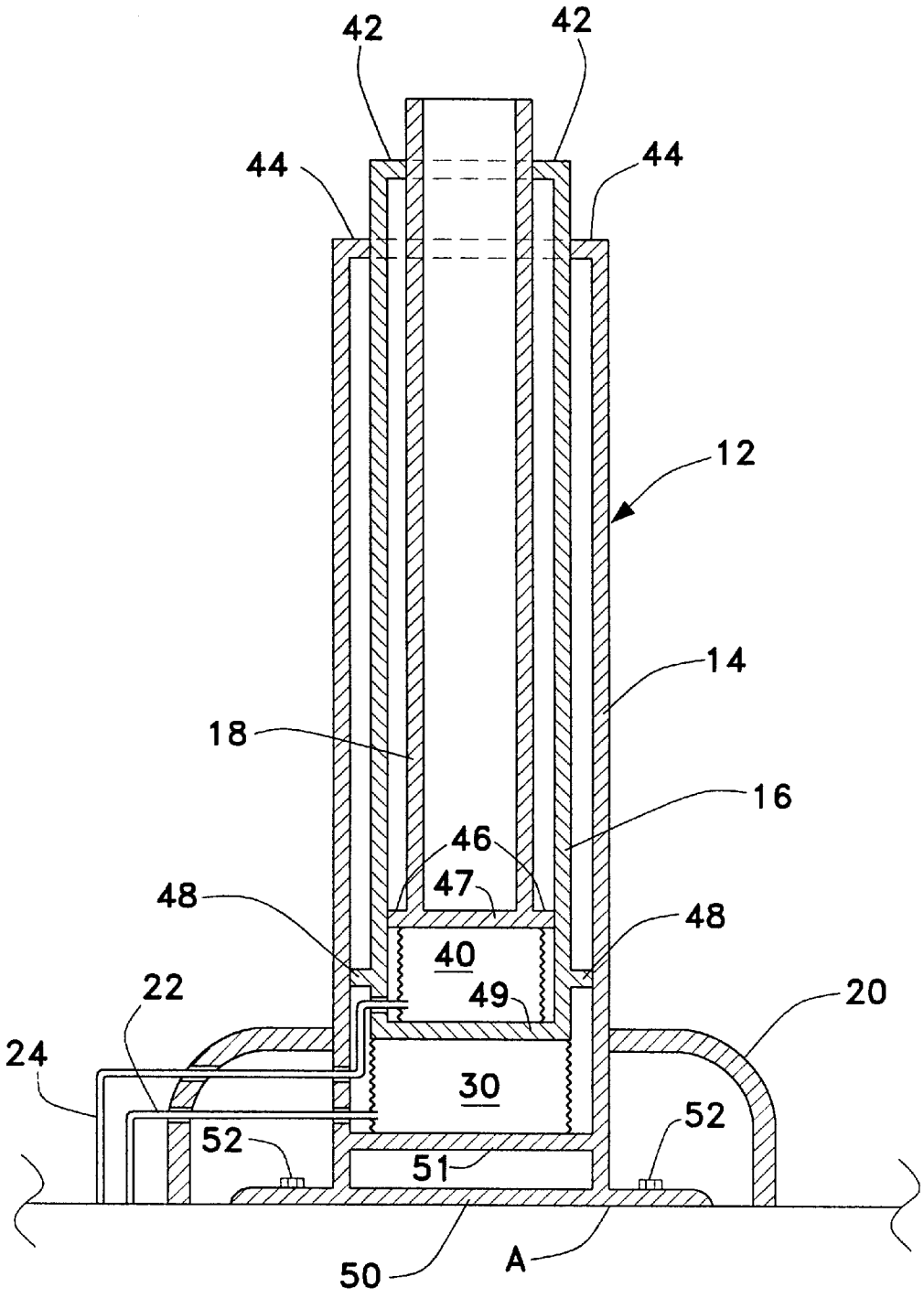
FIG. 5 is a section view drawn along lines 5—5 of FIG. 4.

Referring to FIG. 5 there is shown a sectional view of retractable mast 12 in a retracted position wherein lower mast section 14, central mast section 16, and upper mast section 18 are concentrically nested. Lower section pneumatic line 22 is connected to lower lift bag 30 shown in its deflated state. Center section pneumatic line 24 is connected to center section lift bag 40.

Center mast section 16 features upper stop 42 and lower stop 48 mounted internally near its upper end and lower end, respectively. Lower mast section 14 features upper stop 44 mounted internally near its upper end. Upper mast section 18 features lower stop 46 near its lower end. Upper mast section 18 features lower end wall 47. Center mast section 16 features end wall 49. Lower mast section 12 features lower end wall 51. Mast 12 rests on base 50 attached by fasteners 52 to deck A of sailboat B. Pneumatic line 24 to lift bag 40 is shown truncated for illustration purposes, but in use would necessarily be of sufficient length for the full erection of center mast section 16.

In operation, retractable mast 12 is erected by supplying air under pressure through lines 22 and 24 to lower lift bag 30 and upper lift bag 40, respectively, thus, forcing center mast section 16 and upper mast section 18 to telescope upward by pressing on their respective lower end walls 49 and 47, respectively. Center mast section 16 is retained by its lower stop 48 when it reaches lower mast section stop 44. Upper mast section 18 is retained by its lower stop 46 when it reaches center mast section upper stop 42. When it is desired to retract mast 12, air is released through valves 26 and 28(see FIG. 2) from lower lift bag 30 and upper lift bag 40, respectively, allowing upper mast section 18 and center mast section 16 to collapse by force of gravity into lower mast section 14.

Alternative embodiments may include 2, 3, or more sections employing any desired number of inflatable bags. The upper mast sections may be open at their respective ends and inflatable bags contained in the upper mast section to assist in its erection. The mast sections may be circular, elliptical, or other configuration as desired and may be constructed of aluminum or other metal or synthetic material. The bags may be constructed of rubber or other flexible or expandable material or structure.

Figure 6:
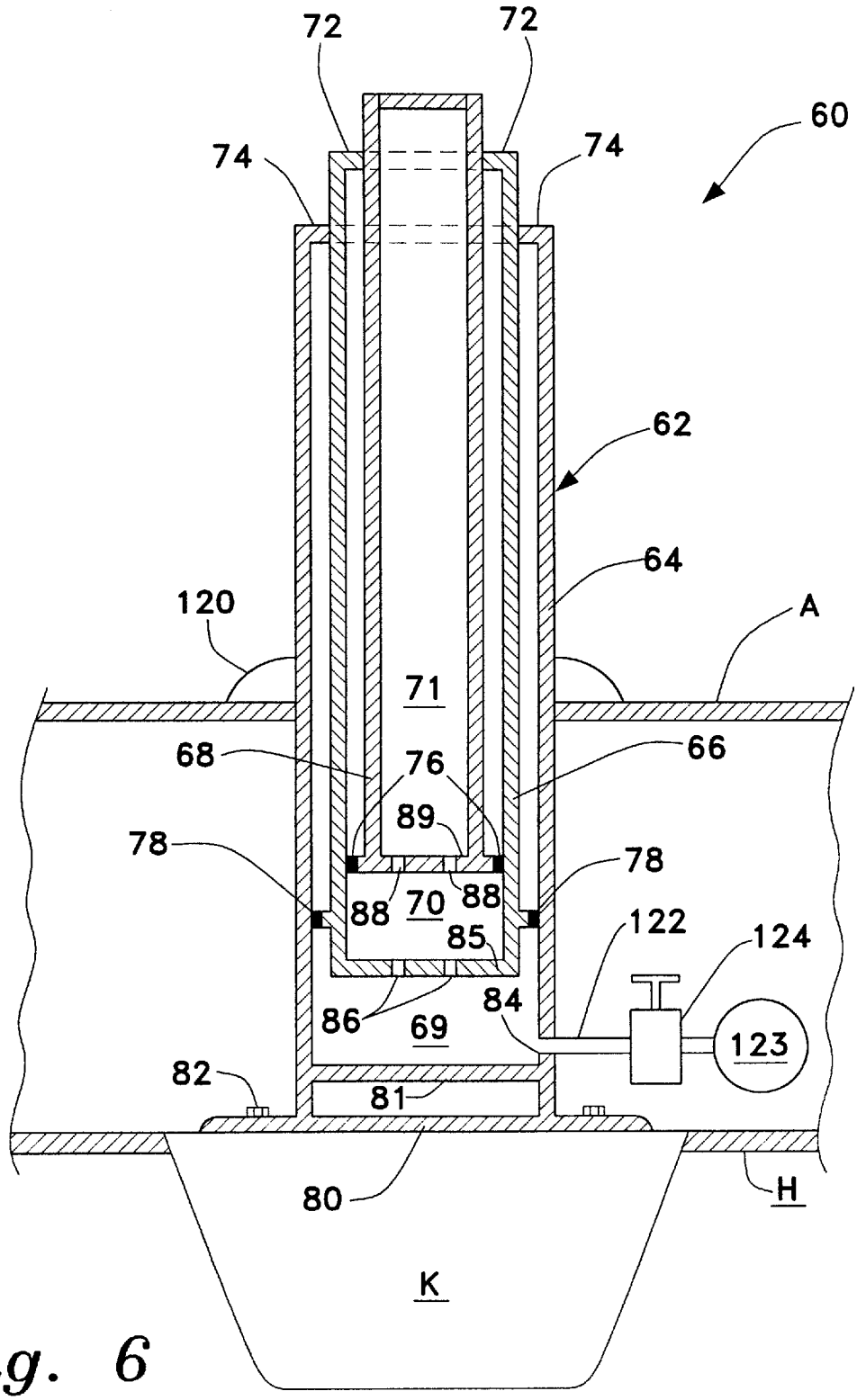
FIG. 6 is a modified section view similar to FIG. 5, illustrating another embodiment of the invention.

Referring to FIG. 6, there is shown a sectional view similar to that of FIG. 5, illustrating another embodiment 60 of the retractable mast sailboat of the present invention. Retractable mast sailboat 60 has a retractable mast 62 consisting of mast lower section 64, mast central section 66, and mast upper section 68. Lower chamber 69, middle chamber 70, and upper chamber 71 are formed by retractable mast lower section 64, mast central section 66, and mast upper section 68. Central section upper stop 72 defines the furthest extension of mast upper section 68. Lower section upper stop 74 defines the furthest extension of mast central section 66.

Upper mast section 68 features upper section airtight seal 76 which interacts with the inner surface of central mast section 66 to form an airtight seal for middle chamber 70. Central mast section 66 features central section airtight seal 78 which interacts with the inner surface of lower mast section 64 to form an airtight seal for lower chamber 69. Mast base 80 is directly attached to keel K by mast base fasteners 82 through boat hull H.

Lower chamber pressure air inlet 84 allows the entrance of pressurized air into lower chamber 69, middle chamber 70, and upper chamber 71 through middle chamber lower wall 85 by means of middle chamber lower wall orifices 86, and upper chamber lower wall 89 by means of upper chamber lower wall orifices 88, respectively. Pressurized air is supplied by pressurized air bottle 123 through line 122, the air pressure being controlled by pressure regulator valve 124, and then passes through lower chamber pressure air inlet 84 and into lower chamber 69.

Figure 7A:
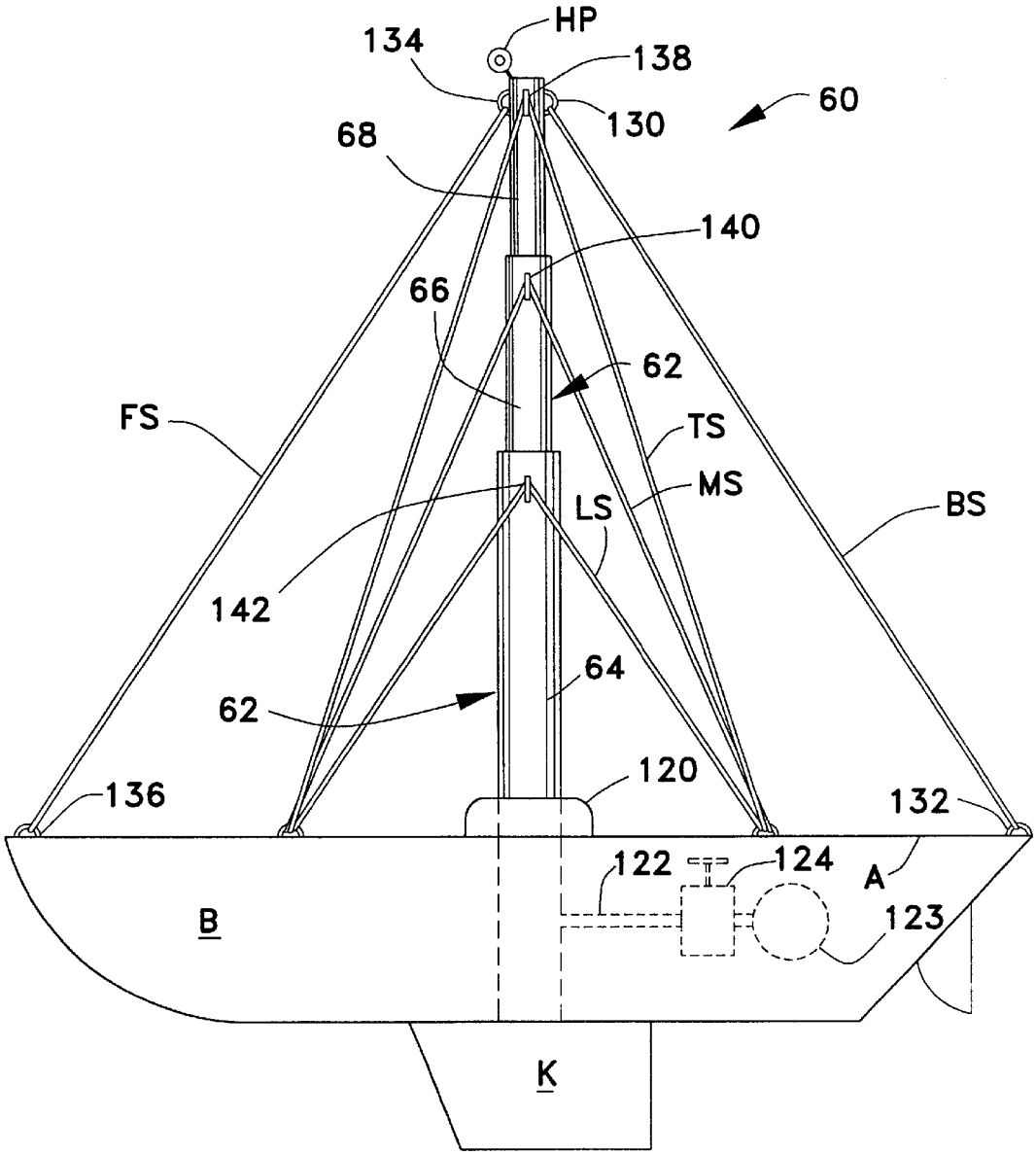
FIG. 7A is a view in elevation of an embodiment of the invention illustrating rigging components and a pressure air delivery system.

Referring to FIG. 7A, there is illustrated an embodiment of the inventive retractable mast sailboat 60 having rigging features and a supply of compressed air. Sailboat B features collapsible mast 62 in an extended state supported by inflated air bags or pressure sealed chambers as described above. The shrouds as shown are duplicated(not shown) on the opposite side of the mast. Air pressure is supplied to the retractable mast in the manner of the embodiment of FIG. 6, above. Upper backstay mount 130 is attached near the upper end of mast upper section 68. Lower backstay mount 132 is attached to the stern portion of deck A, and backstay BS extends between and attaches to mast upper section 68 and lower backstay mount 132.

Upper front stay mount 134 is attached near the upper end of mast upper section 68. Lower front stay mount 136 is attached to the bow portion of deck A, and front stay FS extends between and attaches to mast upper section 68 and lower front stay mount 136.

Top shroud mount 138 is attached near the upper end of mast upper section 68. Top shrouds TS are attached to and extend between mount 138 and boat deck A. Upper shrouds middle shroud mount 140 is attached near the upper end of mast central section 66. Middle shrouds MS are attached to and extend between mount 140 and boat deck A. Lower shroud mount 142 is attached near the upper end of mast lower section 62. Lower shrouds LS are attached to and extend between mount 142 and boat deck A.

Stays FS and BS and shrouds LS, MS, and TS are made of flexible material such as wire rope so as to conveniently lay on the deck A when mast 62 is in a retracted position. One or more halyard pulleys HP are attached to the very top of mast 62 (halyards are not shown). Compressed air is supplied to extend mast 62 from air bottle 123 by means of air line 122 whose pressure is controlled by regulator valve 124.

Figure 7B:
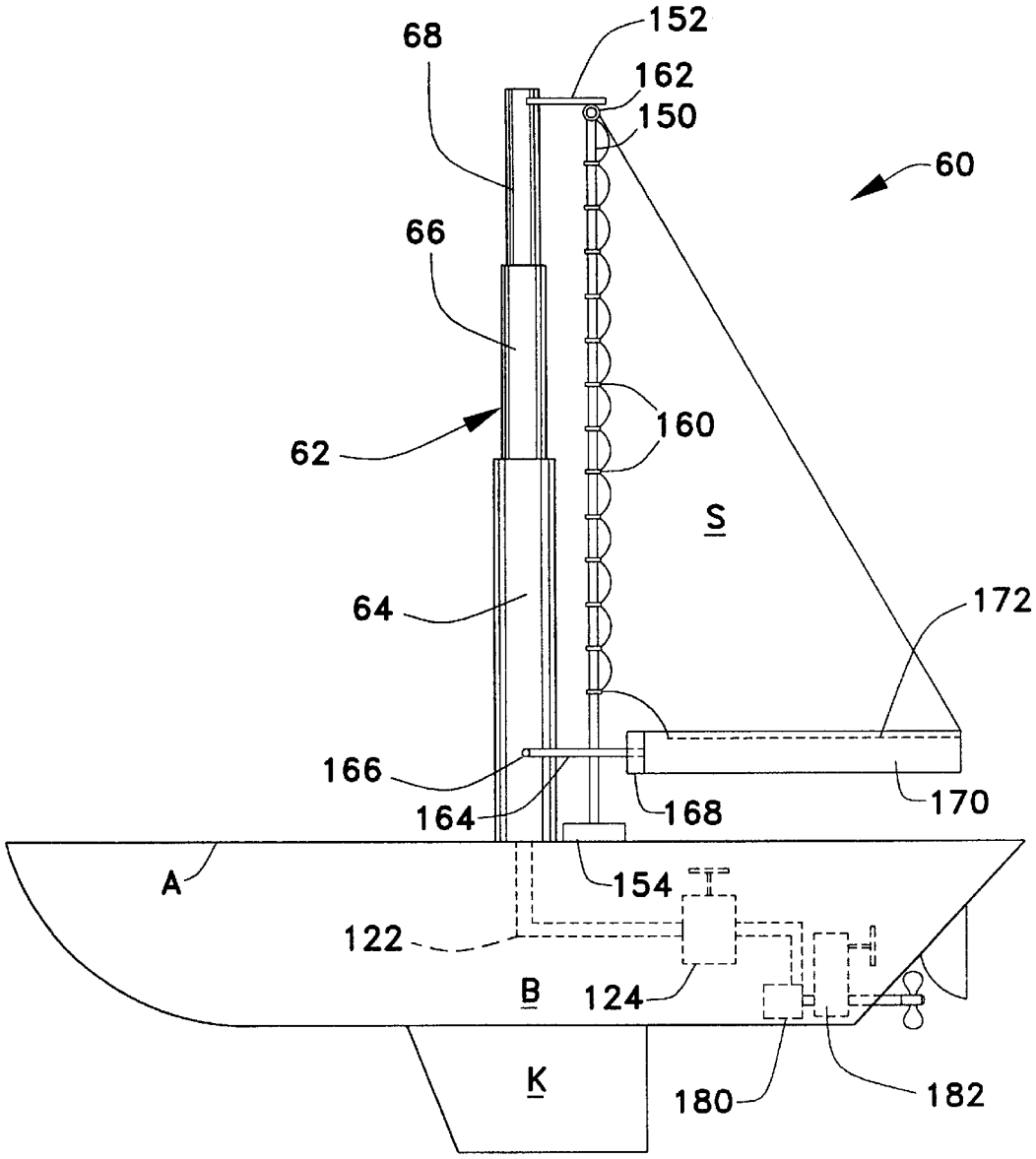
FIG. 7B is a view in elevation similar to that of FIG. 7A illustrating the installation of a sail, a boom, and a stiffener rod, with air pressure provided by an engine-driven compressor.

Referring to FIG. 7B, there is presented a view in elevation similar to that of FIG. 7A, illustrating the installation of a sail, a boom, and a mast stiffener, with air pressure provided by an engine-driven compressor, wherein stiffener 150 is mounted between upper stiffener mount 152 attached at the upper end of mast 62, and lower stiffener mount 154, located on deck A. The stiffener 150 is preferably an integral rod or tube of a relatively unyielding metal such as stainless steel, so as to help support the mast 62 in its fully extended condition when under sail. Stiffener rod 150 also provides a convenient means of supporting sail S, by means of hoops 160. A halyard pulley 162 is attached to the upper end of stiffener 150 to assist in raising the main sail S(the halyard is not shown).

Boom bracket 164 is located at a convenient distance above deck A to opposing sides of mast lower section 64. Boom bracket swivel 168 rotatably attaches boom 170 with boom bracket 164. The lower edge of main sail S is attached to boom 174 by sail slot 172 formed along the upper length of boom 170. Sail S may alternatively be fully supported by retractable mast 62 by means of hoops, zippers, slots, etc. as may be convenient. As shown in this embodiment, compressed air may be provided to mast 62 through pressure air lines 122 and regulator 124 by means of air compressor 180 driven by boat motor 182.

Figure 7C:
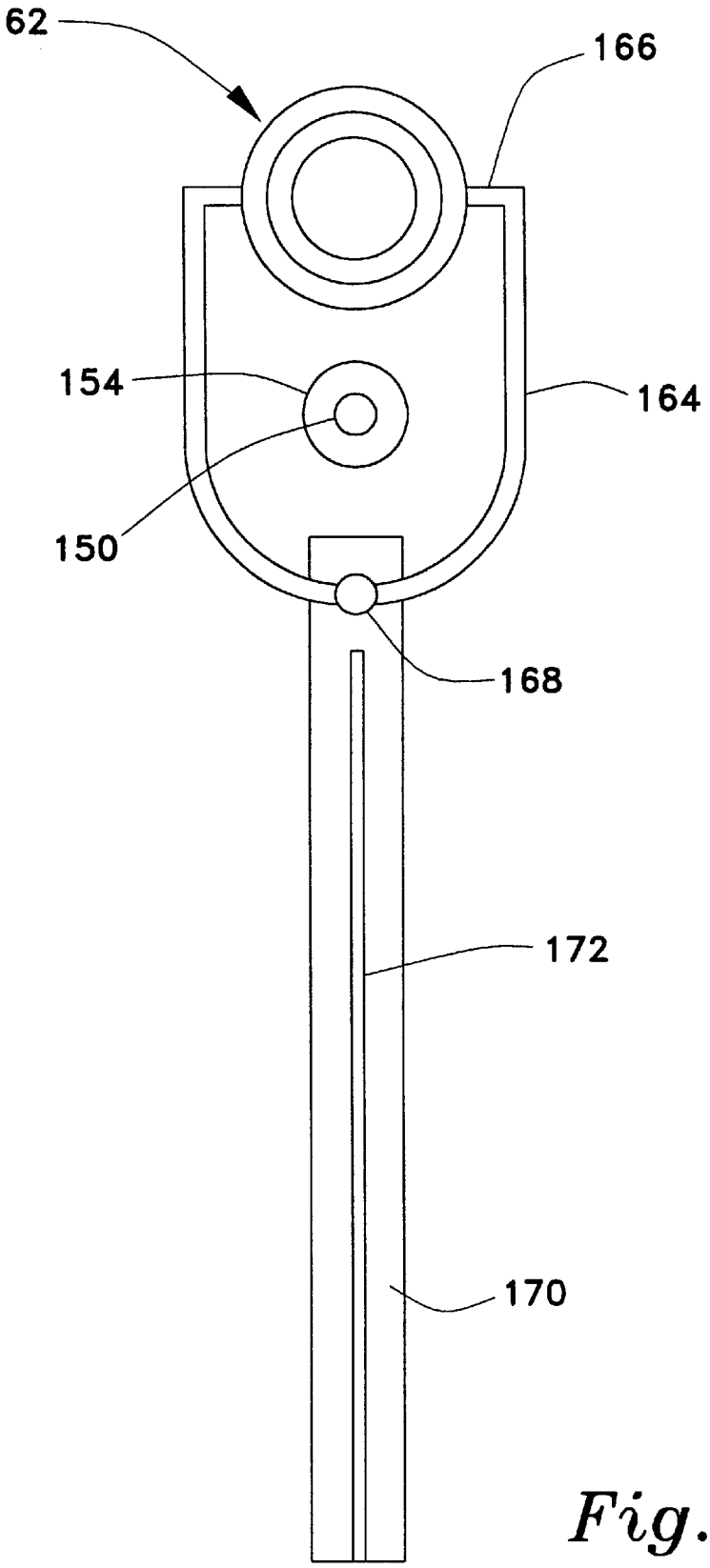
FIG. 7C is a plan view of the boom of FIG. 7B, illustrating the mast mounting bracket, stiffener rod, and boom.

Referring to FIG. 7C, there is shown a plan view of the boom of FIG. 7B, illustrating the mast mounting bracket and stiffener rod, wherein retractable mast 62 supports boom bracket 164 by means of boom bracket mast mounts 166. Boom bracket 164 surrounds stiffener 150, shown in lower mount 154, with enough clearance that stiffener 154 may be easily installed after the extension of retractable mast 62 to its maximum height. Boom bracket swivel 168 rotatably attaches boom 170 to bracket 164 by a pin in the manner of a hinge.(not shown) Sail slot 172 extends along the length of boom 170 to receive sail S(see FIG. 7B).

In operation, retractable mast 62 is erected by supplying pressurized air from pressure air bottle 123 to mast lower chamber 69. The pressurized air pushes on the middle chamber lower wall 85, extending mast central section 66 upwardly. Simultaneously, pressurized air enters mast middle chamber 70 by means of middle chamber lower wall orifices 86 of such size as to allow maintenance of sufficient pressure within lower chamber 69 to raise mast central section 66. Similarly, pressurized air entering middle chamber 70 exerts pressure on upper chamber lower wall 89, extending mast upper section 68 upwardly. Upper chamber lower wall 89 may also have orifices therethrough to allow equalizing air pressure to build up within upper chamber 71. In this mode of operation the mast upper section 68 is sealed at its top.

One or both of the respective middle chamber lower wall 85 and upper chamber lower wall 89 may be omitted as desired, leaving the entire interior of retractable mast 62 open as a single pressurized chamber when extended for sailing. Once the mast is extended, the sail is inserted in sail slot 172 and hoops 160 placed over the stiffener 150. The stiffener 150 is then erected by placing it through the clearance of boom bracket 164 and securing it between upper stiffener mount 152 and lower stiffener mount 154. The sail S is then raised by pulling on the sail halyard(not shown) over sail halyard pulley 162. A halyard(not shown) may be attached to the upper end of the retractable mast to assist in retracting the mast as desired. Air or other pressurized gas is preferred to hydraulic fluid, due to the additional weight of the fluid, increasing the weight of the erected mast, which tends to degrade overall sail boat performance.

The features of the various embodiments may be combined as desire and any such combinations are considered to be within the scope of the present invention. A head sail(not shown) may be installed in each of the embodiments in a known manner. Inner seals may be located at upper mast section stops as well as lower mast section stops.

It is to be understood that the present invention is not limited to the sole embodiment described above, but encompasses any and all embodiments within the scope of the following claims.

I claim:

1. A retractable and extendable mast system for sailboats comprising:

a mast having a plurality of hollow mast sections which are capable of nesting in a retracted position and telescoping upward to an extended position;.

at least one inflatable chamber located within at least one of said mast sections; and a source of pressurized fluid connected with said at least one chamber for inflation of said inflatable chamber;

whereby upon inflation of said chamber, said mast extends from a said retracted position to said extended position.

2. The mast system of claim 1, said mast further comprising at least one pressure relief valve connected with said at least one chamber for release of said pressurized fluid, allowing said chamber to contract and, thus, allowing said mast to retract.

3. The mast system according to claim 1, wherein each of said at least one inflatable chambers of said mast contains a bag which is both inflatable and deflatable.

4. The mast system of claim 1, said plurality of mast sections of said mast comprising a lower mast section, a center mast section, and an upper mast section.

5. The mast system of claim 4, wherein each said upper mast section, said center mast section, and said lower mast section has a closed lower end wall and wherein an upper inflatable and deflatable lift bag is located between said upper mast section lower end wall and said center mast section lower end wall and a lower inflatable and deflatable lift bag is located between said center mast section lower end wall and said lower mast section lower end wall.

6. The mast system of claim 4, wherein said lower mast section has an upper stop disposed between said lower mast section and said center mast section, said center mast section has a lower stop between said center mast section and said lower mast section, said center mast section has an upper mast section between said center mast section and said upper mast section, and said upper mast section has a lower stop disposed between said upper mast section and said center mast section, said stops being so disposed as to engage upon said center mast and said upper mast are extended to their respective maximum heights.

7. The mast system of claim 6, wherein each of said stops encircles its respective mast section and each of said stops further comprising a seal extending from said stop to an adjacent mast section so said mast sections form a sealed, telescoping mast upon introduction of pressurized fluid.

8. The mast system of claim 7, wherein said upper mast section having a closed upper end wall a lower end wall defining a plurality of orifices and said center mast section has a lower end wall defining a plurality of orifices, said lower mast section having an inlet for introducing pressurized fluid at a point near its lower end and below said lower stop of said center mast section, whereby pressurized fluid enters said lower mast section, travels through said center mast section lower end wall, and through said upper mast section lower end wall, thus erecting said mast.

9. The mast system of claim 7, wherein said sailboat has a keel and said lower mast section is mounted to said keel.

10. The mast of claim 7, said mast system further comprising a source of pressurized fluid and a pressure line connecting said source of pressurized fluid and said mast.

11. The mast system of claim 10, further comprising a pressurized tank connected with said pressure line for supplying pressurized fluid to said mast.

12. The mast system of claim 11, said source of pressurized fluid being an engine-driven air compressor connected with said pressure line.

13. The mast system of claim 12, wherein said engine is the motive engine for said sailboat.

14. The mast system of claim 7, wherein said sailboat has a bow at a fore end, and a stern at an aft end, a starboard side and a port side, and a keel, said mast system further comprising a flexible pair starboard fore and aft shrouds connected between each of said plurality of mast portions near the extended upper end of each respective mast portion and said sailboat.

15. The mast system of claim 14, further comprising a flexible fore stay attached between said bow of said sailboat and said upper end of said upper mast portion, and a flexible aft stay attached between said stern of said sailboat and said upper end of said upper mast portion.

16. The mast system of claim 7, further comprising an upper stiffener mount located at the upper end of said upper mast section and a lower stiffener mount mounted to said sailboat at the base of said lower mast section, and a stiffener insertable into said stiffener mounts of such length as to extend erect between said stiffener mounts when said mast is fully extended upwards so as to maintain said mast fully extended.

17. The mast system of claim 16, further comprising a plurality of sail hoops for attachment to a main sail and a halyard pulley located at the upper end of said upper portion of said mast, and a halyard attached to said main sail, said hoops surrounding said erect stiffener, said hoops being attached along said main sail such that said hoops are spaced along said stiffener when said halyard is pulled over said pulley, thereby deploying said main sail.

18. The mast system of claim 17, further comprising a boom attached to said mast lower section, said boom having a sail slot for receiving said main sail.

19. The mast system of claim 18, said boom further comprising a boom bracket attached to opposing sides of said lower mast section, said boom bracket extending around said stiffener when erected, said boom bracket having a swivel at a portion opposite that of said lower mast section, said stiffener lower mount being mounted of the deck of said sailboat.

20. The mast system of claim 19, said boom being supported for rotation about a forward end thereof by said boom bracket swivel whereby said main sail may be rotated between starboard and port for purposes of setting said sail for a desired tack.

* * * * *